US011168680B2

(12) United States Patent
Oohata

(10) Patent No.: US 11,168,680 B2
(45) Date of Patent: Nov. 9, 2021

(54) AIR COMPRESSOR

(71) Applicant: Hitachi Industrial Equipment Systems Co., Ltd., Tokyo (JP)

(72) Inventor: Akito Oohata, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/642,251

(22) PCT Filed: Mar. 14, 2018

(86) PCT No.: PCT/JP2018/009999
§ 371 (c)(1),
(2) Date: Feb. 26, 2020

(87) PCT Pub. No.: WO2019/102631
PCT Pub. Date: May 31, 2019

(65) Prior Publication Data

US 2021/0071660 A1 Mar. 11, 2021

(30) Foreign Application Priority Data

Nov. 24, 2017 (JP) ..... JP2017-225975

(51) Int. Cl.
*F04B 49/02* (2006.01)
*F04B 35/04* (2006.01)
*F04B 41/02* (2006.01)

(52) U.S. Cl.
CPC ..... *F04B 49/022* (2013.01); *F04B 35/04* (2013.01); *F04B 41/02* (2013.01); *F04B 2203/0202* (2013.01); *F04B 2205/063* (2013.01)

(58) Field of Classification Search
CPC .. F04B 41/02; F04B 49/022; F04B 2205/063; F04B 2203/0202; F04B 35/04
See application file for complete search history.

(56) References Cited

U.S. PATENT DOCUMENTS 7,326,038 B2 * 2/2008 Iimura ..... F04B 41/02 417/20
8,784,070 B2 * 7/2014 Yokota ..... F04B 49/00 417/44.2

(Continued)

FOREIGN PATENT DOCUMENTS

JP 2004-124711 * 4/2004
JP 2011-220288 A 11/2011

(Continued)

OTHER PUBLICATIONS

Machine translation of JP 5517715; 2004.*

(Continued)

*Primary Examiner* — Christopher S Bobish
(74) *Attorney, Agent, or Firm* — Crowell & Moring LLP

(57) ABSTRACT

An air compressor includes a compressor main body that compresses air; a storage tank that stores the gas compressed by the compressor main body; a motor that rotates a rotary shaft to drive the compressor main body; and a control unit that controls a drive of the motor. In a case where a value of a voltage to be supplied to the motor is lower than a first voltage value, the control unit detects a stop time of the compressor and changes an operation stop pressure which is a pressure to stop the drive of the motor, based on the stop time.

7 Claims, 6 Drawing Sheets

(56) References Cited

U.S. PATENT DOCUMENTS

| | | | | |
|---|---|---|---|---|
| 10,598,174 | B2 * | 3/2020 | Ohkubo | F04B 41/02 |
| 2006/0045752 | A1 * | 3/2006 | Beckman | F04B 49/065 417/44.2 |
| 2020/0173434 | A1 * | 6/2020 | Ohkubo | F04B 49/065 |

FOREIGN PATENT DOCUMENTS

| | | | |
|---|---|---|---|
| JP | 2013-155718 | A | 8/2013 |
| JP | 5517715 | B2 * | 6/2014 |
| JP | 2017-66980 | A | 4/2017 |

OTHER PUBLICATIONS

International Search Report (PCT/ISA/210) issued in PCT Application No. PCT/JP2018/009999 dated Jun. 19, 2018 with English translation (three (3) pages).

Japanese-language Written Opinion (PCT/ISA/237) issued in PCT Application No. PCT/JP2018/009999 dated Jun. 19, 2018 (three (3) pages).

* cited by examiner

AIR COMPRESSOR

TECHNICAL FIELD

The present invention relates to an air compressor, particularly, to the technique of an air compressor that is effective in a situation where a supply voltage decreases.

BACKGROUND ART

A portable air compressor which is used as an air source for a nailing machine or a painting machine is a product that is assumed to be used in an environment where the supply voltage is unstable due to the use of a cord reel or the like, or an octopus wiring, in addition to being used with a temporary outdoor power source. In the use of the portable air compressor in Japan, the power source voltage normally is 100 V, and whereas, the power source voltage may fall below 50 V depending on environment.

Patent Document 1 discloses a technique of preventing a compressor from stopping operating at a low voltage by changing an operation stop pressure and an operation return pressure at a low voltage.

CITATION LIST

Patent Document

Patent Document 1: JP 2011-220288 A

SUMMARY OF THE INVENTION

Problems to be Solved by the Invention

The air compressor which is used as an air source mainly for a nailing machine makes progress toward increasing compression pressure in order to improve the working efficiency. This air compressor is a reciprocating type compressor and adopts a two-stage compression method to realize high compression pressure; however, when the compressor compresses air to the maximum specified pressure and the compressor stops, a residual pressure remains in a high pressure side cylinder. When a user uses an air tool such as a nailing machine, the pressure in a storage tank decreases and the compressor tries to restart. However, in a case where there is the residual pressure in the high pressure side cylinder, the residual pressure becomes a load torque at the start. When the drive torque of a motor is greater than the load torque, the compressor can restart; however, when the supply voltage to the compressor is low, the drive torque of the motor decreases and it becomes difficult for the compressor to restart.

Then, according to Patent Document 1, in a case where the supply voltage to the compressor decreases lower than a predetermined value, the load torque is to be lowered by lowering the control pressure range of the compressor and decreasing the residual pressure in the high pressure side cylinder, and thus, the startability is secured. The above-described problem does not occur in a case where whenever the compressor stops, the pressure in the cylinder is released by using an electromagnetic valve, a push solenoid, or the like; however, there remains a problem from the viewpoint of securing the reliability of the electromagnetic valve or the like, or the cost.

It is possible to secure the startability and the reliability of the compressor by using control to lower the control pressure range in response to the supply voltage; however, since the control pressure range decreases more than normal, the amount of air which can be stored in the storage tank decreases, and accordingly, also the working efficiency of the user decreases.

An object of the present invention is to provide an air compressor that improves the working efficiency of a user by increasing the storage pressure in a storage tank without lowering the control pressure more than necessary even though the supply voltage decreases.

Solutions to Problems

According to a preferred example of the present invention, there is provided an air compressor including a compressor main body that compresses air; a storage tank that stores the gas compressed by the compressor main body; a motor that rotates a rotary shaft to drive the compressor main body; and a control unit that controls a drive of the motor, in which in a case where a value of a voltage to be supplied to the motor is lower than a first voltage value, the control unit detects a stop time of the compressor and changes an operation stop pressure which is a pressure to stop the drive of the motor, based on the stop time.

Effects of the Invention

According to the present invention, it is possible to obtain the air compressor that improves the working efficiency of a user by increasing the storage pressure in the storage tank without lowering the control pressure more than necessary even though the supply voltage decreases.

MODE FOR CARRYING OUT THE INVENTION

Hereinafter, examples will be described in detail with reference to the drawings.

Example 1

Figure 1:
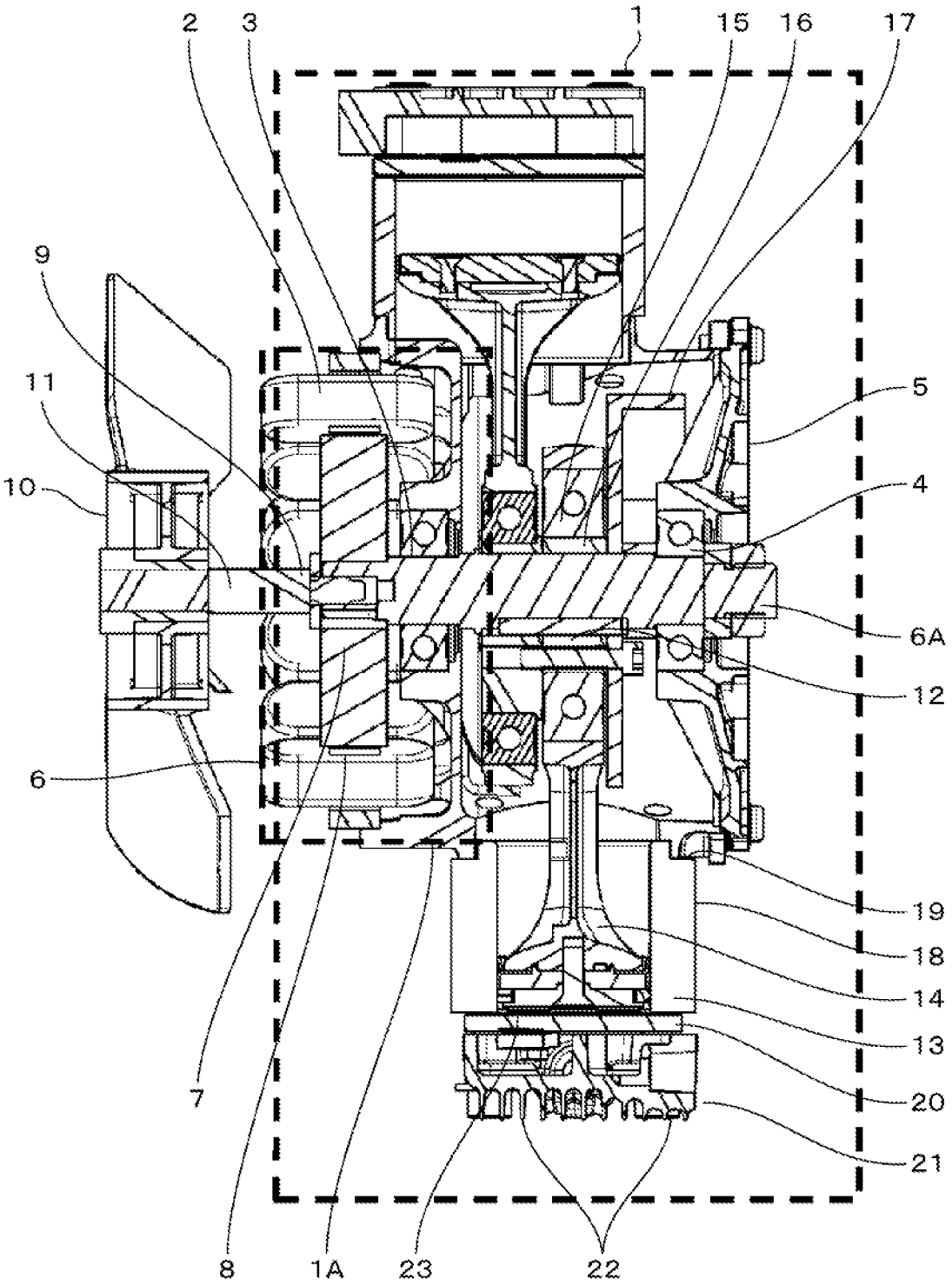
FIG. 1 is a view for describing the internal configuration of a main body of a compressor according to Example 1.

In an integrated tank-type air compressor according to Example 1, the structure of a compressor main body 1 which compresses air will be described with reference to FIGS. 1 and 2.

1 denotes a compressor main body that compresses air. The compressor main body 1 includes a crankcase 1A and a cylinder 18 attached to the crankcase 1A. A shaft (rotary shaft) 6A of a motor 6 penetrates through the crankcase 1A.

1A denotes a crankcase that covers the compressor main body 1 and the motor 6. The crankcase 1A has a structure where a stator 2 is directly fixed to and a bearing 3 is mounted on one end side of the crankcase 1A, and a bearing housing 5 in which a bearing 4 is mounted is fitted to a side of the crankcase 1A which is opposite to the side to which the stator 2 is attached. In addition, a central portion of the shaft 6A penetrating through the crankcase 1A includes a key 12. In addition, a connecting rod assembly 14 with a piston ring 13 for sealing and compressing air is inserted with a balance 17 via an eccentric 16 that is eccentric with respect to a bearing 15. The connecting rod assembly 14 and the balance 17 are supported on two bearings 3 and 4 mounted in the crankcase 1A and the bearing housing 5 on both sides.

6 denotes a motor that drives the compressor main body 1. The motor 6 includes the stator 2, the bearing 3, the shaft 6A, a key 7, a rotor 8, and a washer 9. A cooling fan 10 is provided in an end portion of the shaft 6A. In addition, the rotor 8 is mounted on one end side of the shaft 6A via the key 7. The rotor 8 is fixed in an axial direction by the washer 9 and a fan shaft 11 for attaching the cooling fan 10.

10 denotes a cooling fan that cools configuration elements such as the compressor main body 1 and storage tanks 24 and 25 of the integrated tank-type air compressor by supplying cooling air inside a cover 26 which will be described later. The cooling fan 10 is provided in the end portion of the shaft 6A by means of the fan shaft 11, and is driven by the motor 6. 18 denotes a cylinder attached to the crankcase. In Example 1, two cylinders 18 are provided, and a pair of the cylinders 18 are attached to face each other with the crankcase interposed therebetween. The cylinder 18 includes a flange 19, an air valve 20, and a through bolt 22.

The flange 19 for attaching the cylinder 18 is provided in the crankcase 1A. The cylinder 18, the air valve 20, and a cylinder head 21 are fixed to the flange 19 with the through bolt 22 to form a compression chamber 23.

The operation of the compressor main body 1 in Example 1 will be described. In the compressor main body 1 of Example 1, when the rotor 8 is driven to rotate the shaft 6A, the connecting rod assembly 14 and the piston ring 13 reciprocate in the compression chamber 23 owing to the eccentric 16. In an intake stroke where the piston ring 13 moves from a top dead center toward a bottom dead center, air is taken into the compression chamber 23 through the cylinder head 21 and the air valve 20. In this structure, conversely, in a discharge stroke where the piston ring 13 moves toward the top dead center, the intake air is discharged through the air valve 20 and the cylinder head 21 while the intake air is being compressed. The air discharged through the cylinder head 21 is stored in the storage tanks 24 and 25 which will be described later.

Subsequently, the control of the compressor main body 1 in Example 1 will be described with reference to FIG. 3.

Figure 2:
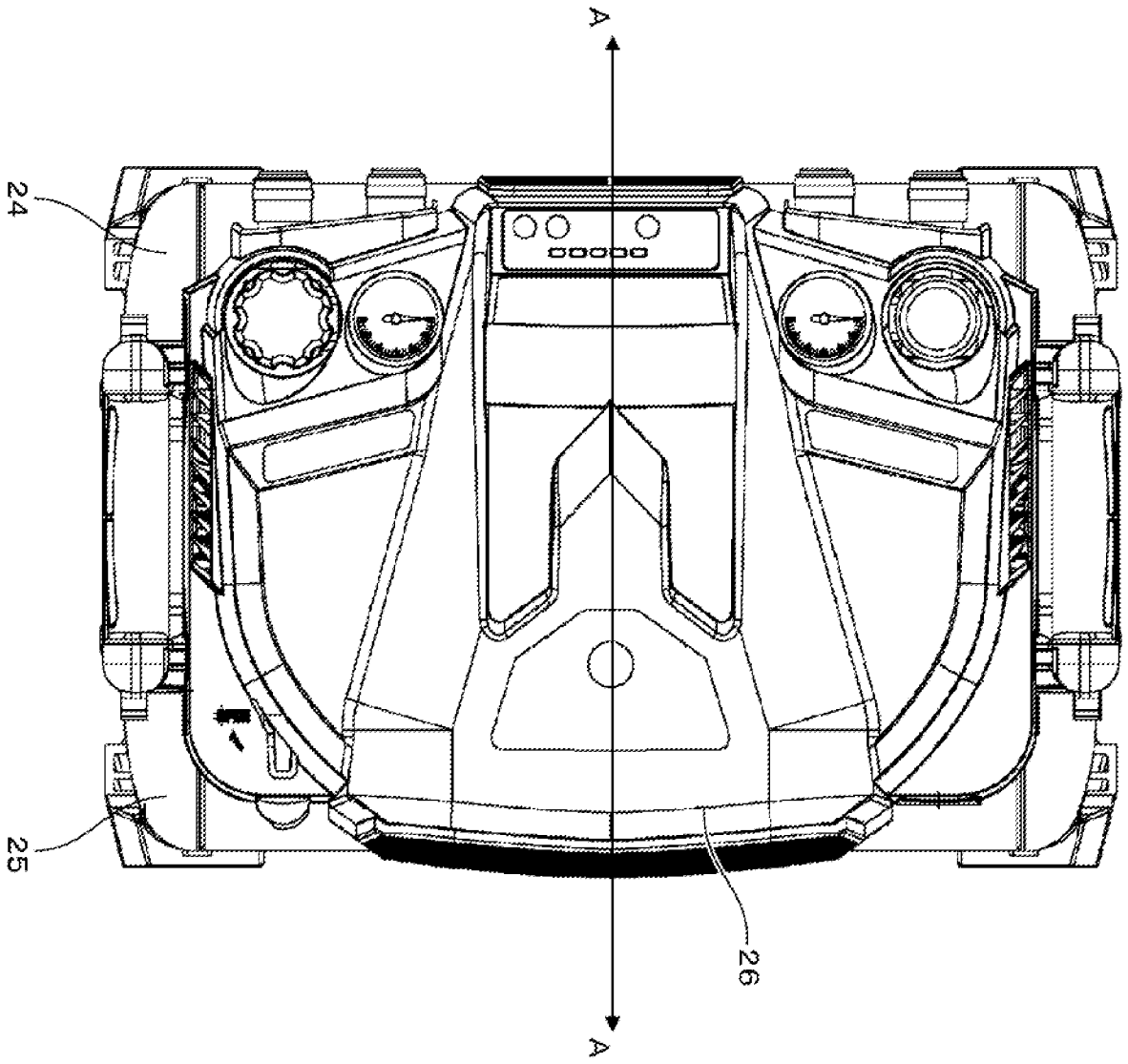
FIG. 2 is an exterior view of the compressor according to Example 1.
Figure 3:
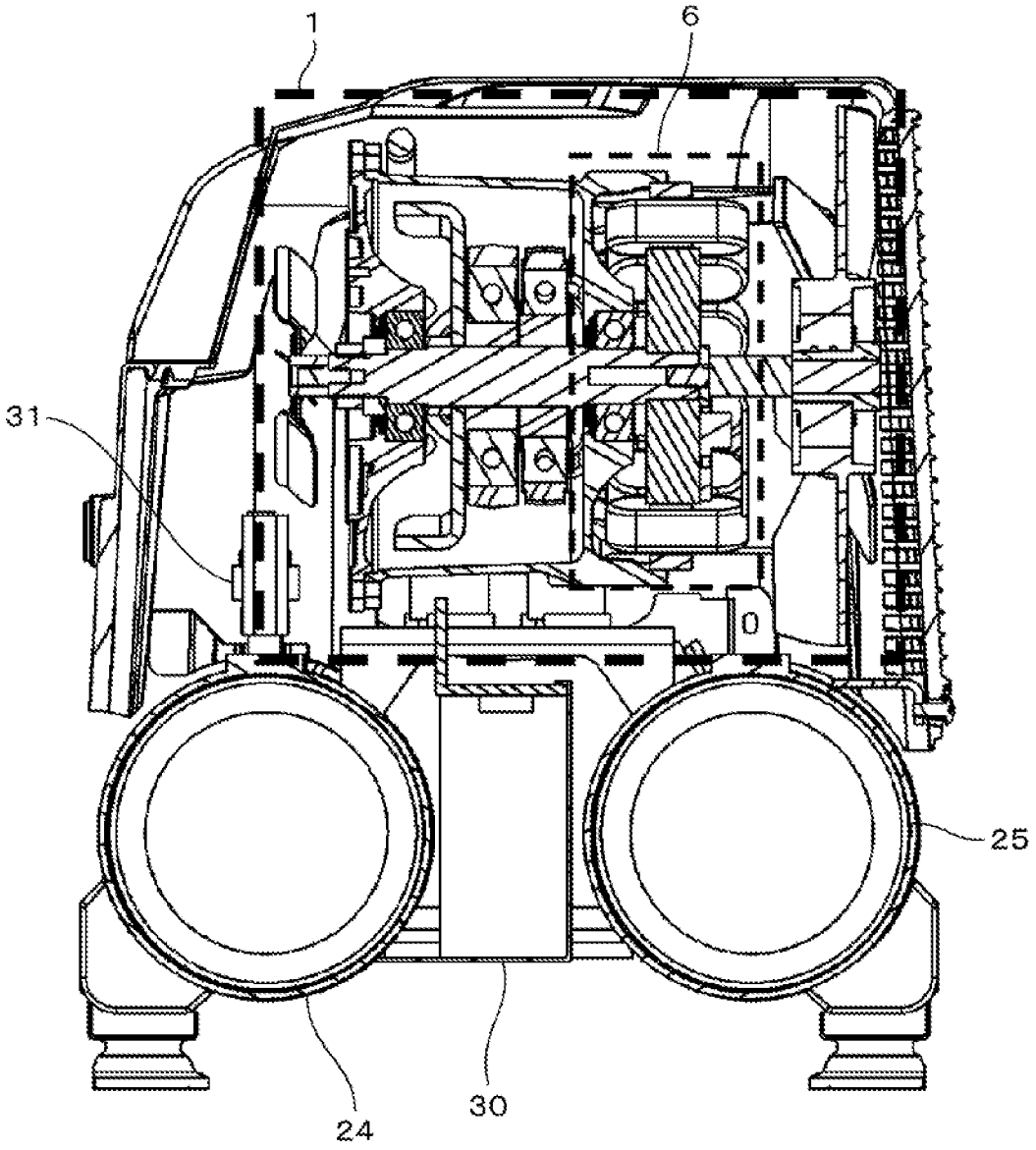
FIG. 3 is a cross-sectional view of the compressor taken along a cutting line A-A in FIG. 2.

FIG. 3 is a cross-sectional view of the integrated tank-type air compressor taken along a cutting line A-A in FIG. 2. The compressor main body 1 is disposed above two storage tanks 24 and 25. A control unit 30 which controls the operation of the integrated tank-type air compressor is disposed between the two storage tanks 24 and 25. The integrated tank-type air compressor adopts a pressure operation control method, and the control unit 30 performs operation control in response to the pressure that is sensed with a pressure sensor 31 attached to the storage tank 24.

Figure 4:
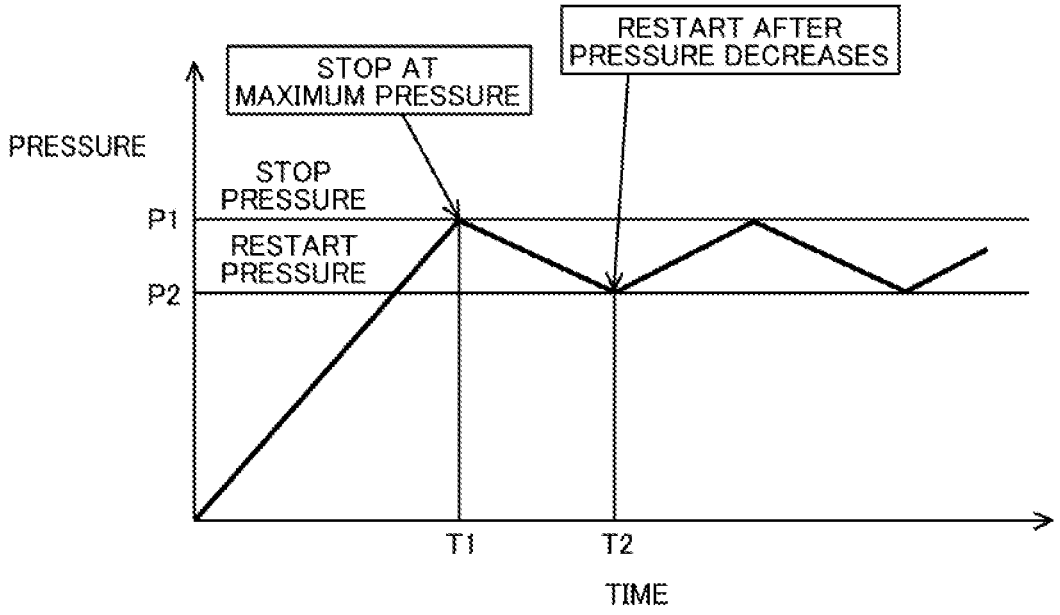
FIG. 4 is a graph showing a normal operation pattern of the compressor.
Figure 5:
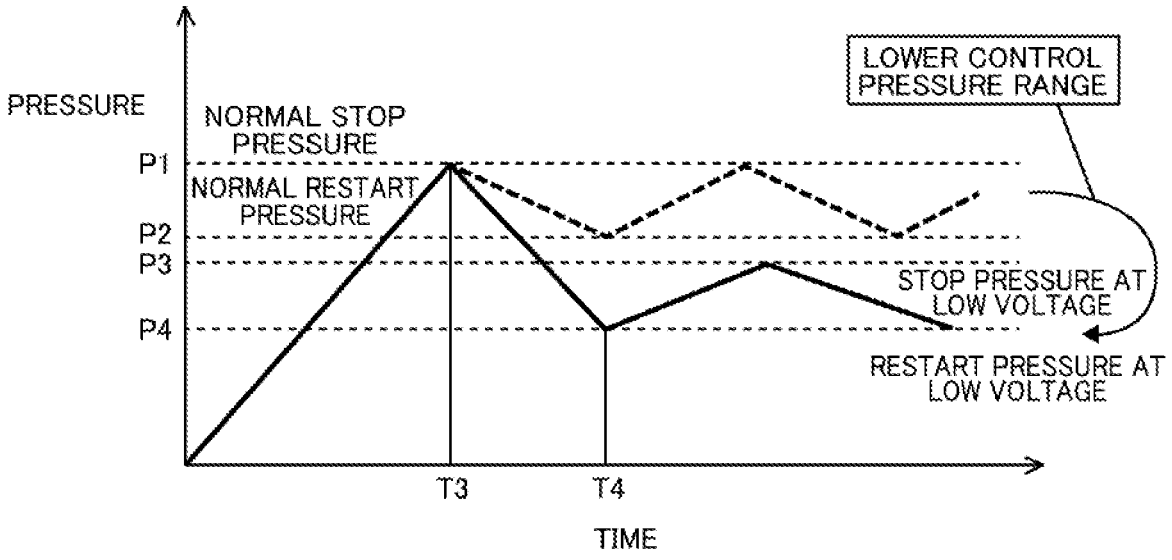
FIG. 5 is a graph showing a low voltage operation pattern of the compressor.

Subsequently, an operation control method for the integrated tank-type air compressor in Example 1 will be described with reference to FIG. 4 showing a normal operation pattern of the compressor and FIG. 5 showing a low voltage operation pattern of the compressor.

This air compressor performs operation control that is a combination of current control, rotation speed control, and pressure control. In the current control, a current value is detected with the control unit 30 and control is performed such that the current value does not exceed a threshold value. In the rotation speed control, control is performed such that the rotation speed which is detected with a rotation sensor provided in the motor 6 becomes a predetermined rotation speed. In the pressure control, the pressure in the storage tanks 24 and 25 is detected with the pressure sensor 31, and control is performed such that when the pressure increases to a predetermined pressure P1, the operation stops, and when air in the storage tanks 24 and 25 is consumed and the pressure decreases to a predetermined pressure P2, the operation restarts.

The integrated tank-type air compressor has low voltage pressure control in addition to normal pressure control. This machine which is used as an air source for a nailing machine or the like has a portable structure and is used with a temporary power source in many cases, and the supply voltage may be unstable due to the use of a cord reel or the like, or an octopus wiring. When the supply voltage decreases lower than a normal voltage of 100 V, the drive torque of the motor 6 is insufficient, and thus, there is a risk that air cannot be compressed up to a normal operation stop pressure P1, or there is a risk that the air compressor cannot start at a normal operation restart pressure P2.

Then, as described in Patent Document 1, in the integrated tank-type air compressor in the related art, in a case where the supply voltage decreases lower than a specified value, the operation pressure control range is lowered by performing the stop voltage pressure control from the viewpoint of protecting the product. When the air compressor starts and the pressure of the storage tanks 24 and 25 reaches the normal operation stop pressure P1, the control unit 30 stops driving the motor 6 to stop the air compressor. Here, in a case where the supply voltage to the air compressor is lower than a first specified voltage value (for example, 80 V), as shown in FIG. 5, the operation restart pressure is changed from a normal pressure of P2 to P4, and the operation stop pressure is changed from P1 to P3. In a case where the supply voltage to the compressor becomes the specified value (for example, 80 V) or greater again, the operation stop pressure and the operation restart pressure are changed to P1 and P2 within a normal pressure control range, respectively.

Here, the pressure control of the compressor according to Example 1 will be described with reference to FIG. 1 and FIGS. 4 to 6.

When the supply voltage to the compressor decreases, the compressor may not be able to operate normally within the normal pressure control range from P1 to P2 shown in FIG. 4. Particularly, in the air compressor illustrated in FIG. 1 which performs compression by driving the motor 6 to convert the rotational motion into the reciprocating motion via a crank mechanism, after the compressor stops, the remaining of compressed air in the compression chamber 23 on a high pressure side is a main cause of the problem that the operation cannot restart. When compressed air remains in the compression chamber 23, the compressed air becomes a load torque, and when the supply voltage decreases, the start torque of the motor 6 decreases. In a case where the load torque including mechanical loss exceeds the start torque, the motor 6 cannot start, namely, a start failure occurs. In a case where the pressure of the storage tank is a high pressure of 2.0 MPa or greater and less than 5.0 MPa, the problem of decrease in workability such as a start failure occurs due to the remaining of the compressed air in the compression chamber 23.

On the one hand, after the compressor stops, the compressed air remaining in the compression chamber 23 gradually escapes into the crankcase 1A from a gap between the piston ring 13 and the cylinder 18. As a result, in a case where the pressure of the compressed air remaining in the compression chamber 23 decreases, the load torque decreases and it becomes easy for the motor 6 to start.

In the example, the piston ring made of PTFE as a base material and the cylinder made of aluminum are used for the compression of air in the air compressor which is a target; however, there is a very small gap between an outer periphery of the piston ring and an inner surface of the cylinder which form a sealing line, when the compressor stops, as the time elapses, a residual pressure in the cylinder escapes as blow-by from the cylinder. In a case where the residual pressure escapes from the cylinder, even in a state where the supply voltage to the product decreases and the drive torque of the motor decreases, it is possible to secure the startability of the compressor. In Example 1, in a case where the control unit detects the stop time of the compressor and a predetermined time elapses, the amount of lowering of the control pressure range specified by the operation stop pressure and the operation restart pressure is reduced, or the lowering is not performed.

Figure 6:
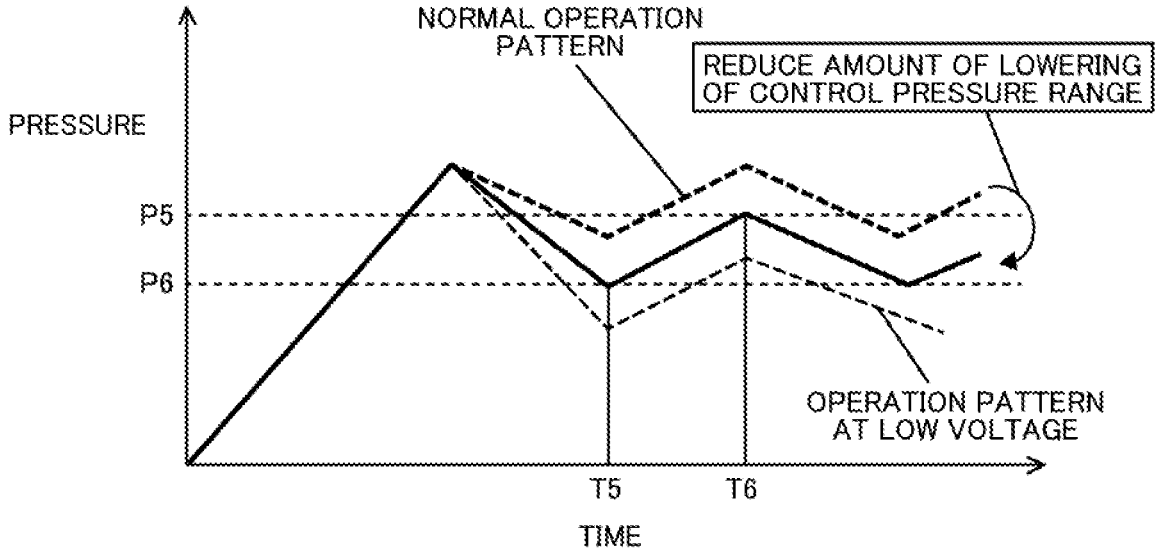
FIG. 6 is a graph showing an example of the operation pattern of the compressor according to Example 1.

In Example 1, as shown in FIG. 6, the control unit 30 detects the supply voltage and the stop time after the stop of the compressor, for example, even though the supply voltage is the predetermined value (for example, 80 V) or less, in a case where the time after the stop of the compressor is a predetermined time (for example, 10 seconds) or greater, the amount of lowering of the operation stop pressure and the operation restart pressure is reduced.

In Example 1, in a case where the time after the stop of the compressor is less than the predetermined time (for example, 10 seconds), as shown in FIG. 5, the operation stop pressure at a low voltage is lowered from P1 to P3. Furthermore, the operation restart pressure to restart the motor 6 is lowered from P2 to P4.

In a case where the time after the stop of the compressor is the predetermined time (for example, 10 seconds) or greater, as shown in FIG. 6, the operation stop pressure is lowered from P1 to P5. Furthermore, the operation restart pressure is lowered from P2 to P6.

In addition, in a case where the time after the stop of the compressor is a first time (for example, 20 seconds) or greater, the operation stop pressure and the operation restart pressure are set at the same pressures as the normal operation stop pressure P1 and the normal operation restart pressure P2 when the supply voltage to the compressor is the first specified voltage value (for example, 80 V) or greater. As a result, in a case where the time after the stop of the compressor is the first time (for example, 20 seconds) or greater, even though the supply voltage to the compressor is lower than the first specified voltage value, the stop pressure and the operation restart pressure may not be lowered.

Figure 7:
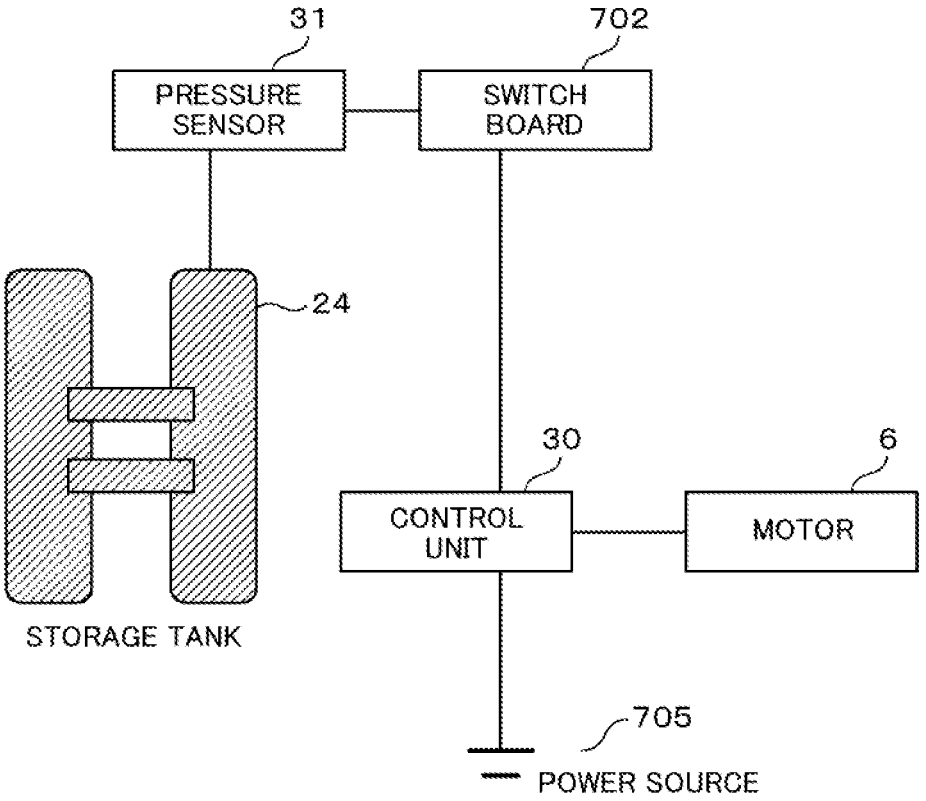
FIG. 7 is a control system diagram of an air compressor according to Example 1.

The system configuration will be described with reference to FIG. 7 which is a system configuration diagram relating to the control of the air compressor. This system configuration includes the following configuration elements. The configuration elements include the pressure sensor 31 that is attached to the storage tank 24 to detect the pressure in the storage tank 24; a power source 705 that supplies a supply voltage to the air compressor; the control unit 30 that detects the voltage of the power source 705 and measures the stop time of the air compressor with a timer provided inside the control unit 30; a switch board 702 that outputs a signal to cause an operation unit (not illustrated) to notify a user that the voltage of the power source 705 is in a low voltage state, based on an instruction from the control unit 30 in a case where the voltage of the power source 705 detected by the control unit 30 is in a low voltage state; and the motor 6 that is controlled by the control unit 30.

Figure 8:
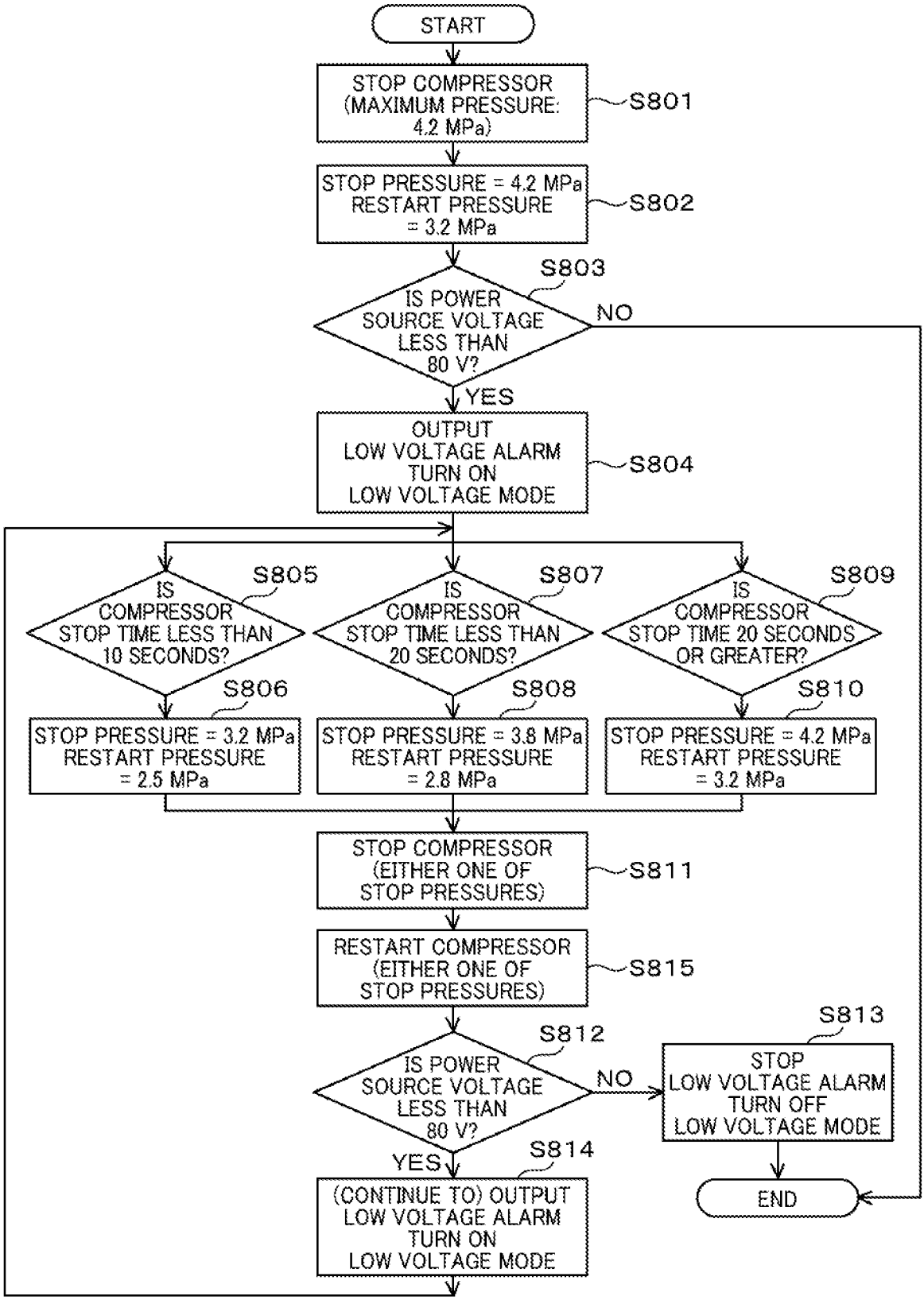
FIG. 8 is a flowchart of a process executed by a control unit according to Example 1.

An example of the flow of control executed by the control unit of the air compressor in Example 1 will be described with reference to FIG. 8.

The control unit 30 performs control to stop the compressor (S801). The operation stop pressure to stop the operation of the air compressor is set at 4.2 MPa, and the pressure to restart the air compressor is set at 3.2 MPa (S802). The control unit 30 determines whether or not the voltage of the power source 705 is less than 80 V (S803). In a case where the voltage is less than 80 V, the control unit 30 outputs a signal to the switch board 702 to output a low voltage alarm, and the switch board 702 causes the operation unit or the like to notify a user that the voltage is in a low voltage state and turns on a low voltage mode (S804). In a case where the voltage is 80 V or greater, this flow ends.

The control unit 30 measures the time from the stop of the compressor with the internal timer, and determines whether or not the compressor stop time is less than 10 seconds, whether or not the compressor stop time is less than 20 seconds, and whether or not the compressor stop time is 20 seconds or greater (S805, S807, and S809). In a case where the compressor stop time is less than 10 seconds, the operation stop pressure is set at 3.2 MPa and the restart pressure is set at 2.5 MPa (S806). In a case where the compressor stop time is 10 seconds or greater and less than 20 seconds, the operation stop pressure is set at 3.8 MPa and the restart pressure is set at 2.8 MPa (S808). In a case where the compressor stop time is 20 seconds or greater, the operation stop pressure is set at 4.2 MPa and the restart pressure is set at 3.2 MPa (S810).

In a case where the pressure in the storage tank 24 detected by the pressure sensor 31 is either one of the stop pressures that are set in S806, S808, and S810, the control unit 30 performs control to stop the drive of the motor 6 and then to stop the compressor (S811). In a case where the pressure in the storage tank 24 detected by the pressure sensor 31 is either one of the restart pressures that are set in S806, S808, and S3810, the control unit 30 performs control to restart the motor 6 and then to restart the compressor (S815).

The control unit 30 determines whether or not the voltage of the power source 705 is less than 80 V (S812). In a case where the voltage is less than 80 V, a signal is output to the switch board 702 to output a low voltage alarm, and the switch board 702 causes the operation unit or the like to notify the user of a low voltage state and turns on the low voltage mode (S814). Then, the control unit 30 returns to S805, S807, and S809, and the control unit 30 measures the time from the stop of the compressor with the internal timer, and determines whether or not the compressor stop time is less than 10 seconds, whether or not the compressor stop time is 10 seconds or greater and less than 20 seconds, and whether or not the compressor stop time is 20 seconds or greater.

In a case where the voltage of the power source 705 is 80 V or greater, the control unit 30 performs control to stop the low voltage alarm and to turn off the low voltage mode (S813). Then, the flow of this example ends.

In Example 1, the stop pressure corresponding to the compressor stop time and the restart pressure are described as being the above-described values; however, the stop pressure and the restart pressure are not limited to the above-described values, and in a case where the values of the operation stop pressure and the restart pressure are set to increase as the stop time is extended, this setting leads to an improvement in workability.

According to Example 1, also when the voltage is low, since the pressure of compressed air stored in the storage tanks 24 and 25 can be held high by slightly reducing the amount of lowering without changing the pressure control range of the compressor, it is possible to increase the number of nails which can be driven; and thereby, leading to an improvement in workability for users.

REFERENCE SIGNS LIST

1 Compressor main body
6 Motor
18 Cylinder
24, 25 Storage tank
31 Pressure sensor

The invention claimed is:

1. An air compressor comprising
a compressor main body that compresses air;
a storage tank that stores the air compressed by the compressor main body;
a motor that rotates a rotary shaft to drive the compressor main body; and
a control unit that controls a drive of the motor,
wherein in a case where a value of a voltage to be supplied to the motor is lower than a first voltage value, the control unit detects a stop time of the compressor and changes an operation stop pressure which is a pressure to stop the drive of the motor, based on the stop time;
wherein the control unit selects any one of a plurality of set pressures based on the stop time, and changes the operation stop pressure to the selected pressure; and
wherein the operation stop pressure is set to increase as the stop time is extended, and in a case where the stop time is a first time or greater, the control unit changes the operation stop pressure to the same pressure as the operation stop pressure that is set in a case where the value of the voltage to be supplied to the motor is the first voltage value or greater.

2. The air compressor according to claim 1, further comprising:
a pressure sensor that senses a pressure of the storage tank,
wherein in a case where the sensed pressure reaches the changed operation stop pressure, the control unit performs control to stop the drive of the motor.

3. The air compressor according to claim 1,
wherein an operation restart pressure which is a pressure to restart the motor is changed based on the stop time.

4. The air compressor according to claim 3,
wherein the control unit selects any one of the plurality of set pressures based on the stop time, and changes the operation restart pressure to the selected pressure.

5. The air compressor according to claim 3, further comprising:
a pressure sensor that senses a pressure of the storage tank,
wherein in a case where the sensed pressure reaches the changed operation restart pressure, the control unit performs control to restart the motor.

6. The air compressor according to claim 4,
wherein the operation restart pressure is set to increase as the stop time is extended, and in a case where the stop time is the first time or greater, the control unit changes the operation restart pressure to the same pressure as the operation restart pressure that is set in a case where the value of the voltage to be supplied to the motor is the first voltage value or greater.

7. The air compressor according to claim 1,
wherein the air compressor has a portable structure,
wherein a pressure of the storage tank is 2.0 MPa or greater and less than 5.0 MPa,
wherein the air compressor further includes a mechanism by which a rotational motion generated by driving the motor is converted into a reciprocating motion, and a mechanism that reciprocates its the compressor main body, and
wherein the reciprocating mechanism compresses the air in a compression chamber of the compressor main body.

* * * * *